US006989485B2

(12) United States Patent
Ochi

(10) Patent No.: US 6,989,485 B2
(45) Date of Patent: Jan. 24, 2006

(54) ELECTRONIC MUSIC APPARATUS AND PROGRAM

(75) Inventor: Mitsunori Ochi, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 10/216,027

(22) Filed: Aug. 9, 2002

(65) Prior Publication Data

US 2003/0029304 A1 Feb. 13, 2003

(30) Foreign Application Priority Data

Aug. 9, 2001 (JP) ..... 2001-241733

(51) Int. Cl.
*G10H 7/00* (2006.01)

(52) U.S. Cl. ..... 84/645; 705/51

(58) Field of Classification Search ..... 84/609, 84/645; 705/51–59

See application file for complete search history.

(56) References Cited

U.S. PATENT DOCUMENTS 6,418,421 B1 * 7/2002 Hurtado et al. ..... 705/54
2001/0056375 A1 * 12/2001 Kunii ..... 705/14
2003/0000369 A1 * 1/2003 Funaki ..... 84/609

FOREIGN PATENT DOCUMENTS

| | | | |
|---|---|---|---|
| JP | 6-332485 | A | 12/1994 |
| JP | 8-248953 | A | 9/1996 |
| JP | 2000-36949 | A | 2/2000 |
| JP | 2000-156035 | A | 6/2000 |
| JP | 2001-155069 | A | 6/2001 |
| JP | 2001-211235 | A | 8/2001 |

* cited by examiner

*Primary Examiner*—Jeffrey W Donels
(74) *Attorney, Agent, or Firm*—Rossi, Kimms & McDowell

(57) ABSTRACT

There is provided an electronic music apparatus that can make effective use of song data by separately controlling external outputting of the song data according to songs while protecting the rights. When song data is selected, the song data is read from a second ROM or a flash memory and written into a RAM together with a copyright flag CRF indicating that the song data has a copyright, when it is set to "1". When an external output instruction is given, when the copyright flag CRF corresponding to the selected song data is set to "0", it is judged that the song data has no copyright to be protected. Then, the song data is output according to the external output instruction. On the other hand, if CRF=1 holds, it is judged that the song data has a copyright to be protected, and then an output inhibition message is displayed to inhibit external outputting of the song data.

12 Claims, 11 Drawing Sheets

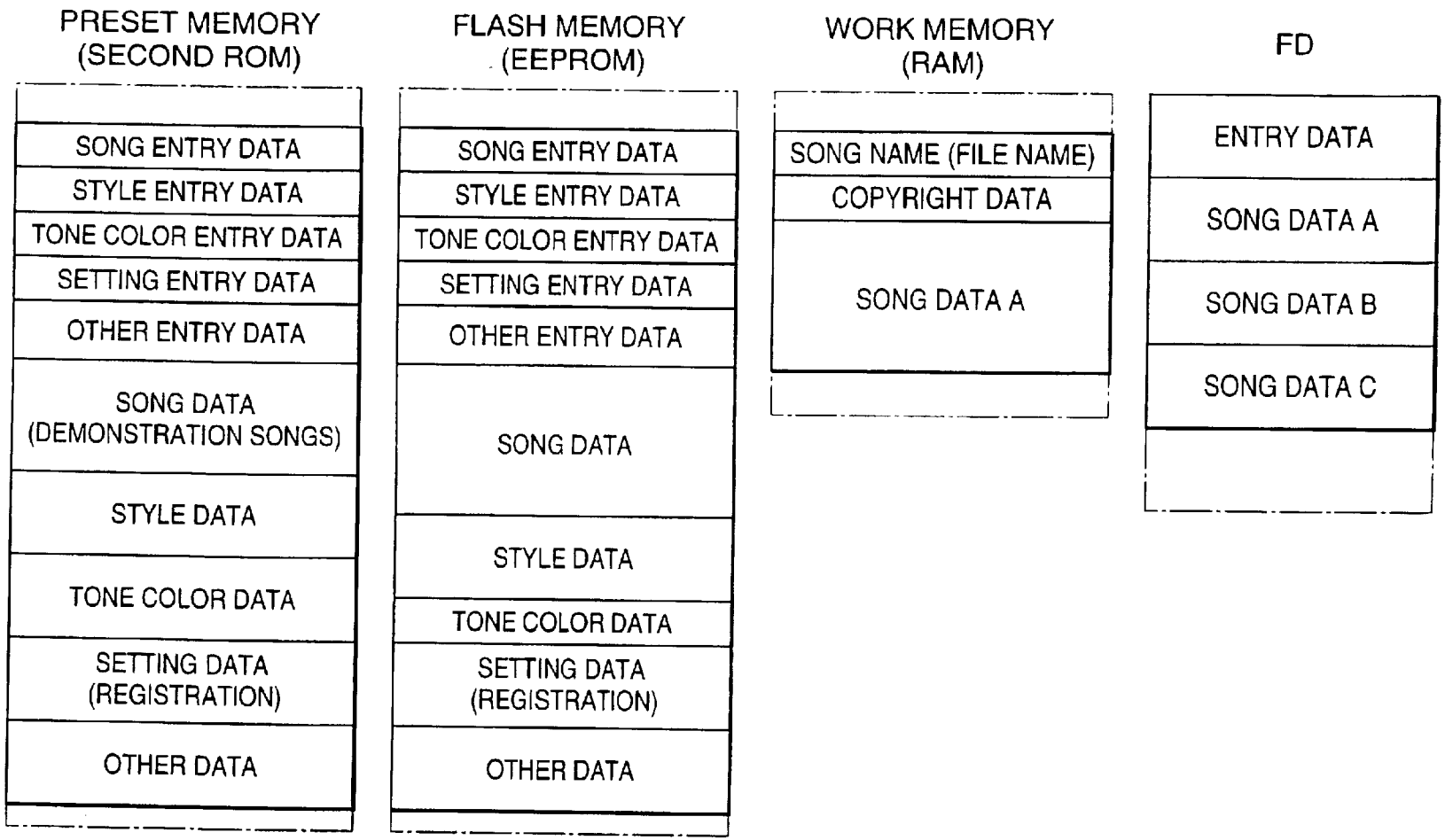
FIG. 2A
PRESET MEMORY (SECOND ROM)
SONG ENTRY DATA
STYLE ENTRY DATA
TONE COLOR ENTRY DATA
SETTING ENTRY DATA
OTHER ENTRY DATA
SONG DATA (DEMONSTRATION SONGS)
STYLE DATA
TONE COLOR DATA
SETTING DATA (REGISTRATION)
OTHER DATA
FIG. 2B
FLASH MEMORY (EEPROM)
SONG ENTRY DATA
STYLE ENTRY DATA
TONE COLOR ENTRY DATA
SETTING ENTRY DATA
OTHER ENTRY DATA
SONG DATA
STYLE DATA
TONE COLOR DATA
SETTING DATA (REGISTRATION)
OTHER DATA
FIG. 2C
WORK MEMORY (RAM)
SONG NAME (FILE NAME)
COPYRIGHT DATA
SONG DATA A
FIG. 2D
FD
ENTRY DATA
SONG DATA A
SONG DATA B
SONG DATA C

ELECTRONIC MUSIC APPARATUS AND PROGRAM

BACKGROUND OF THE INVENTION

1. Field of the Invention

The present invention relates to an electronic music apparatus which can store a plurality of song data for automatic performance before shipment or by loading the song data from an external source, the song data being used for demonstration songs for description of functions, a user's performance practice, or the like, and which can then output the stored song data to an external device or an external storage device, as well as a program for causing a computer to implement a control method for the electronic music apparatus.

2. Description of the Related Art

Electronic music apparatuses have been known which are constructed to store a plurality of song data for automatic performance before shipment or by loading the song data from an external source, the song data being used for demonstration songs, a user's performance practice, or the like and to read desired data of the song data for automatic performance. Some of the electronic music apparatuses are constructed to read the stored song data as required and edit and restore or output them to an external device or an external storage device. These apparatuses can be constructed in various forms such as electronic music instruments, karaoke apparatuses, or personal computers which have performance operators such as keyboards.

Many electronic music apparatuses are provided with external output means such as a MIDI interface or a floppy disk (FD) drive. Furthermore, electronic music apparatuses are being realized which have a network function and can exchange data with other recording media such as HD, CD-R, or flash memory. It is thus technically easy to externally output song data stored inside the apparatus without degrading the reproduction quality.

With recent development of automatic performance function, performance guide function, and the like, several tens of to one hundred or more demonstration songs or automatic performance songs have been preset in the apparatus. Furthermore, relatively new songs have been contained in the apparatus to enhance commercial competitiveness. Some of the demonstration songs employed are of a PD type for which copyright protection is not required. However, the relatively new songs normally involve copyrights.

Conventional electronic music apparatuses cope with copyrights by obtaining the right (recording right) to use copyrighted songs in the apparatuses as demonstration songs or the like, from JASRAC (Japanese Society for Rights of Authors, Composers, and Publishers), the song writers, or the like, then creating the corresponding MIDI song data, and subsequently storing them in a non-volatile built-in memory so that the data can be used on the electronic music apparatuses for automatic performance, key depression guiding operations, or for other purposes. In general, the recording right permits the user to use the copyrighted songs only on the electronic music apparatus for automatic performance, key depression guiding operations, or for other purposes, though it depends on the contents of the contract on the recording right. That is, the copyrighted songs are often inhibited from being externally output or copied unlimitedly.

In addition to the copyright of the original, MIDI song data involve the neighboring right or the like of a person who has created the MIDI data. However, PD song data can be freely externally output or copied by a user of the electronic music apparatus unless the neighboring right or the like is claimed. In particular, if the provider of the electronic music apparatus has the neighboring right or the like to a PD song, he can permit the user to freely use the PD song for the user's performance practice, thereby enhancing the availability. This is rather desirable.

However, if, for example, the conventional electronic music apparatus is provided with demonstration songs or the like stored in a built-in memory, the stored songs are often comprised of PD songs and copyrighted songs mixed together. Accordingly, to protect the copyrighted songs, such arrangements are typically employed that both PD and copyrighted songs are uniformly inhibited from being externally output or copied. Thus, the PD songs cannot be effectively used. On the other hand, there is a demand for ensuring that the copyrighted songs are protected.

Further, some of the conventional electronic music apparatuses can capture by downloading or the like not only PD songs but also copyrighted songs from external devices to store them in a flash memory or the like. With these apparatuses, a problem similar to the above-mentioned problem occurs with the song data captured and stored in the flash memory.

Furthermore, for preset songs stored in the electronic music apparatus before shipment, it may be desired that different songs are employed for respective destinations of the electronic music apparatus. Thus, the conventional electronic music apparatuses have different song data preset for example, in a non-volatile built-in memory for the respective destinations to which the electronic music apparatuses are shipped.

However, the number of types of built-in preset memory increases with the number of destinations. This raises a problem that the apparatus has a complicated construction, and increased production and inventory management costs.

SUMMARY OF THE INNOVATION

It is a first object of the present invention to provide an electronic music apparatus that can make effective use of song data by separately controlling external outputting of the song data according to songs while protecting the rights, as well as a program for use in this apparatus.

It is a second object of the present invention to provide an electronic music apparatus that allows a song preset memory to be shared to simplify the construction thereof and reduce costs, as well as a program for causing a computer to implement a control method for the electronic music apparatus.

To attain the first object, in a first aspect of the present invention, there is provided an electronic music apparatus comprising a first storage device that stores a plurality of song data and predetermined right data corresponding to each of the plurality of song data in correspondence with each other, a musical tone signal generating device that externally generates musical tone signals based on the song data stored in the first storage device, an external output device capable of outputting the song data stored in the first storage device, an output accepting device that accepts an output instruction for selectively outputting the song data stored in the first storage device, and an output control device responsive to acceptance of the output instruction by the output accepting device, for controlling external outputting of the song data by the external output device based on the predetermined right data corresponding to the song data selected according to the accepted output instruction.

According to this arrangement, if the output instruction is accepted, then external outputting of the song data selected based on the accepted output instruction is controlled based on the predetermined right data corresponding to the song data. Thus, for example, unlimited external outputting of song data with the right data is avoided by providing such control that external outputting of the song data is inhibited uniformly or conditionally. On the other hand, song data without any right data are permitted to be externally output and can thus be freely used. Consequently, song data can be effectively used while individually controlling external outputting of the song data for each song to protect rights thereof.

Further, preferably, the above electronic music apparatus further comprises a second storage device, and wherein when the song data stored in the first storage device are externally output, the output song data are transferred together with the predetermined right data corresponding thereto to the second storage device, wherefrom the transferred song data are externally output, and wherein the output control device reads the predetermined right data corresponding to the selected song data out from the second storage device, and controls external outputting of the song data by the external output device based on the read predetermined right data.

According to this arrangement, when song data are externally output, the output song data are transferred together with the predetermined right data corresponding thereto to the second storage device, wherefrom the transferred song data are externally output. Then, predetermined right data corresponding to the selected song data are read out from the second storage device, and external outputting of the song data by the external output device is controlled based on the readout predetermined right data. Thus, even if the song data are output via a RAM or the like, external outputting of the song data can be individually controlled for each song. Further, the predetermined right data read out from the second storage device are used, and this expedites the determining process associated with the output control for the song data. Consequently, by regulating the outputting of song data even if the song data are externally output via another storage device or through a MIDI interface, the rights thereof can be more sufficiently and reliably protected. This also expedites the determination as to whether or not the outputting is permitted, for example.

Further, in the above electronic music apparatus, it is preferable that if the predetermined right data corresponding to the selected song data indicates that no right protection is required, the selected song data is permitted to be externally output, and if the predetermined right data corresponding to the selected song data indicates that right protection is required, the selected song data is inhibited from being externally output.

According to this arrangement, if the predetermined right data corresponding to the selected song data indicates that no right protection is required, then the selected song data is permitted to be externally output. On the other hand, if the predetermined right data corresponding to the selected song data indicates that right protection is required, then the selected song data is inhibited from being externally output. Thus, external outputting of song data with copyrights and the like is individually limited for each song to protect the rights, whereas song data without any rights can be effectively used.

Further, in the above electronic music apparatus, the first storage device comprises a first built-in memory that stores the plurality of song data and the corresponding predetermined right data.

According to this arrangement, song data preset in the apparatus can have rights thereof protected or can be effectively used.

Furthermore, in the above electronic music apparatus, the first storage device preferably comprises a first built-in memory in which are stored in advance the plurality of song data and the corresponding predetermined right data, and a second built-in memory capable of loading and storing the song data and the predetermined right data from at least one of an external data providing device in which are stored in advance the plurality of song data and the corresponding predetermined right data and the first built-in memory.

According to this arrangement, the rights can also be protected for song data obtained by executing editing or another process on preset songs and restoring the edited or otherwise processed songs, or obtained by externally inputting song data.

Further, it is preferable that the above electronic music apparatus comprises a conversion and loading device operable when the song data and the predetermined right data are loaded from the external data providing device into the second built-in memory, to convert the predetermined right data into a predetermined format before being stored in the second built-in memory irrespective of a format in which the predetermined right data are stored in the external data providing device.

According to this arrangement, even if the right data of externally loaded song data have different formats, the rights can be more reliably protected by using a unified right data format inside the apparatus to allow the right data to be easily managed.

Furthermore, in the above electronic music apparatus, it is preferable that when the song data and the predetermined right data are loaded from the first built-in memory into the second built-in memory, the predetermined right data are directly stored without being changed in the second built-in memory together with the corresponding song data.

According to this arrangement, for preset songs, predetermined right data are always attached to song data without the right data being changed. Therefore, the rights can be consistently protected even if the song data are restored after having the corresponding file names changed, being edited, or being subjected to another process.

Moreover, in the above electronic music apparatus, preferably, the external output device has at least one of a function of outputting the song data in a form of a file and a function of outputting in real time the song data in a form of MIDI data.

According to this arrangement, the rights can be effectively protected by widely controlling the outputting of the song data which does not cause degradation of the reproduction quality of the song data.

To attain the second object, in a second aspect of the present invention, there is provided an electronic music apparatus that provides different songs contained therein for different destinations, comprising a song data storage device that stores a plurality of song data and destination corresponding data indicative of destinations for respective ones of the plurality of song data in correspondence with each other, a destination data storage device that stores destination data indicative of a destination set for the electronic music apparatus, an access device that makes access to the song data stored in the song data storage device to use the song data, and an access control device that provides such control that the access device is permitted to make access to only song data, out of the song data stored in the song data storage device, corresponding to destination corresponding data matching the destination data stored in the destination data storage device, and is inhibited from accessing other song data.

According to this arrangement, when song data stored in the song data storage device are to be outputted, access is permitted to be made to only song data corresponding to destination corresponding data matching the stored destination data, whereas access to the other song data is inhibited. Thus, even if, for example, the contents of data stored in the song data storage device are unified irrespective of the destinations, accessible song data can be selected depending on the destination based on the destination data. Consequently, the song data storage device can be shared between a plurality of destinations of the apparatus. As a result, only song data suitable for each destination are made accessible to allow the song data preset memory to be easily created and managed and to be shared, to thereby simplify the construction of the apparatus and reduce the costs.

Further, in the above electronic music apparatus, it is preferable that the song data storage device stores song data for a plurality of destinations and destination corresponding data corresponding to respective ones of the song data for the plurality of destinations, whereby the song data storage device can be shared by electronic music apparatuses for the plurality of destinations.

According to this arrangement, the song data preset memory can be shared by electronic music apparatuses for a plurality of destinations, thereby simplifying the construction of the apparatus and reducing the costs Further, to attain the first object, in a third aspect of the present invention, there is provided a program for causing a computer to execute a method of controlling an electronic music apparatus having a storage device that stores a plurality of song data and predetermined right data corresponding to each of the plurality of song data in correspondence with each other, the program comprising a musical tone generating module for generating musical tone signals based on the song data stored in the storage device, an external output module capable of externally outputting the song data stored in the storage device, an output accepting module for accepting an output instruction for selectively outputting the song data stored in the storage device, and an output control module responsive to acceptance of the output instruction by the output accepting module, for controlling external outputting of the song data by the external output module based on the predetermined right data corresponding to the song data selected according to the accepted output instruction.

Furthermore, a computer readable storage medium that stores this program constitutes the present invention.

Further, to attain the second object, in a fourth aspect of the present invention, there is provided a program for causing a computer to execute a method of controlling an electronic music apparatus that provides different songs contained therein for different destinations, the electronic music apparatus having a song data storage device that stores a plurality of song data and destination corresponding data indicative of destinations for respective ones of the plurality of song data in correspondence with each other, and a destination data storage device that stores destination data indicative of a destination set for the electronic music apparatus, the program comprising an access module for making access to the song data stored in the song data storage device to use the song data, and access control module for providing such control that the access module is permitted to make access to only song data, out of the song data stored in the song data storage device, corresponding to destination corresponding data matching the destination data stored in the destination data storage device, and is inhibited from accessing other song data.

Furthermore, a computer readable storage medium that stores this program constitutes the present invention.

The above and other objects, features and advantages of the invention will become more apparent from the following detailed description taken in conjunction with the accompanying drawings.

BRIEF DESCRIPTION OF THE DRAWINGS

FIGS. 2A to 2D are views showing the formats of data in various memories, in which:

FIG. 2A is a view showing the contents of data in a second ROM (preset memory);

FIG. 2B is a view showing the contents of data in a flash memory;

FIG. 2C is a view showing the contents of data in a RAM (work memory); and

FIG. 2D is a view showing the contents of data in an FD;

DETAILED DESCRIPTION OF THE PREFERRED EMBODIMENTS

Figure 1:
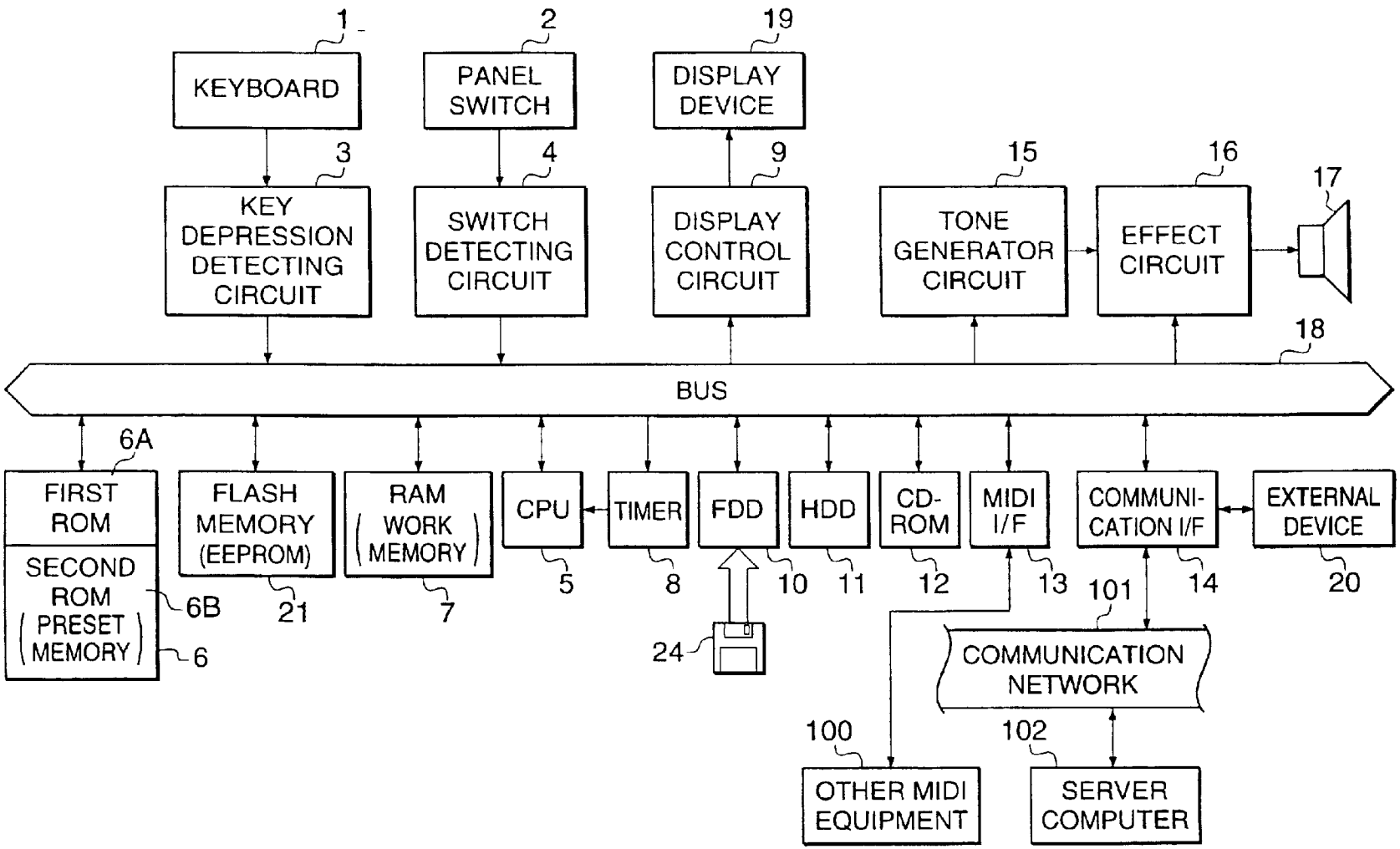
FIG. 1 is a block diagram showing the entire construction of an electronic music apparatus according to an embodiment of the present invention.

The present invention will be described below with reference to the drawings showing preferred embodiments thereof FIG. 1 is a block diagram showing the entire construction of an electronic music apparatus according to an embodiment of the present invention. The apparatus according to the present embodiment is constructed as a keyboard apparatus containing a plurality of song data for automatic performance which are used for demonstration songs for description of functions, a user's performance practice, or the like. The form of the apparatus is not limited to this, but the apparatus may alternatively be constructed as an electronic music instrument, a karaoke apparatus, or a personal computer.

The present apparatus is comprised of a key depression detecting circuit 3, a switch detecting circuit 4, a ROM 6, a RAM 7, a timer 8, a display control circuit 9, a floppy (registered trade mark) disk drive (FDD) 10, a hard disk drive (HDD) 11, a CD-ROM (compact disk read only memory) drive 12, a MIDI (Musical Instrument Digital Interface) interface (MIDI I/F) 13, a communication interface 14, a tone generator circuit 16, and a flash memory 21, all connected to a CPU 5 via a bus 18.

Furthermore, the key depression detecting circuit 3 has a keyboard connected thereto, and the switch detecting circuit 4 has a panel switch 2 connected thereto. The display control circuit 9 has a display device 19 connected thereto and formed, for example, of an LCD. The timer 8 is connected to the CPU 5, and other MIDI equipment 100 is connected to the MIDI I/F 13. A sound system 7 is connected to the tone generator circuit 15 via an effect circuit 16.

A server computer 102 is connected to the communication I/F 14 via a communication network 101. An external device 20 such as a personal computer is further connected to the communication I/F 14. The communication I/F 14 has general-purpose interface functions such as RD-232C, USB (Universal Serial Bus), and IEE 1394, which enable the communication I/F 14 to transmit and receive data to and from the external device 20.

The key depression detecting circuit 3 detects whether or not each key, not shown, of the keyboard is depressed. The panel switch 2 is provided with a plurality of switches, not shown, for inputting various kinds of information. The switch detecting circuit 4 detects depression of each switch of the panel switch 2. The CPU 5 controls the entire present apparatus. The RAM 7 (hereinafter also referred to as the "work memory") temporarily stores various kinds of input information such as automatic performance data and text data, various flags, buffer data, the results of arithmetic operations, and the like. The timer 8 clocks an interruption time during a timer interruption process and various other times. The display control circuit 9 causes the display device 19 to display various kinds of information such as scores.

The ROM 6 is comprised of a first ROM 6A, and a second ROM 6B. The first ROM 6A stores various control processing programs executed by the CPU as described later, various table data, and the like. The second ROM 6B (hereinafter also referred to as the "preset memory") already stores song data of an SMF (Standard Midi File) format as preset demonstration songs.

The flash memory 21 is comprised, for example, of an EEPROM (Electrically Erasable and Programmable ROM). The flash memory 21 restores song data from the second ROM 6B or stores song data from external devices.

The FDD 10 drives a floppy (registered trade mark) disk (FD) 24 as a recording medium. The FD 24 has the above-mentioned programs, various application programs, and various data stored therein. The HDD 11 stores various application programs including the above-mentioned control processing programs as well as various data. The CD-ROM drive 12 drives a CD-ROM, not shown, various application programs including the above-mentioned control processing programs as well as various data.

The MIDI I/F 13 receives and outputs MIDI signals from and to an external device such as the MIDI equipment 100. The communication I/F 14 transmits and receives data to and from, for example, the server computer 102 via the communication network 101. The communication I/F 14 also transmits and receives data to and from the external device 20. The tone generator circuit 15 converts song data into musical sound signals. The effect circuit 16 produces various effects on musical sound signals input by the tone generator circuit 15. The sound system 17, which is comprised, for example of, a DAC (Digital-to-Analog Converter), an amplifier, and speakers, converts musical sound signals input by the effect circuit 16 or the like into sounds.

In the present embodiment, the tone generator circuit 15 is entirely implemented by hardware, as indicated by its name. However, the present embodiment is not limited to this, but this circuit may be partially implemented by software, with the remaining part implemented by hardware. Alternatively, this circuit may be entirely implemented by software.

The HDD 11 can store control processing programs executed by the CPU 5 as described previously. If the first ROM 6A stores no control processing programs, then, by storing control processing programs in a hard disk in the HDD 11 and reading them into the RAM 7, the CPU 5 can be operated similarly to the case in which the ROM 6 stores control processing programs. This facilitates addition of control processing programs, replacement of control processing programs with new versions, and the like.

Control processing programs or various data read out from the CD-ROM by the CD-ROM drive 12 are stored in the hard disk in the HDD 11. This facilitates new installation of control processing programs, replacement of control processing programs with new versions, and the like. Besides the CD-ROM drive 12, other devices such as a magnet optical (MO) disk device which utilize various forms of media may be provided as external storage devices.

The communication I/F 14 is connected to the communication network 101 such as a LAN (Local Area Network), the Internet, or a telephone line and to the server computer 102 via the communication network 101, as stated above. If none of the above-mentioned programs or various parameters are stored in the hard disk in the HDD 11, the communication I/F 14 is used to download programs and parameters from the server computer 102. A computer as a client (in the present embodiment, the electronic music apparatus) transmits a command to the server computer 102 via the communication I/F 14 and the communication network 101, to request that a program or parameter(s) be downloaded. Upon receiving the command, the server computer 102 distributes the requested program or parameter(s) to the computer via the communication network 101. Then, the computer receives the program or parameter(s) via the communication I/F 101 and stores the same in the hard disk in the HDD 11 to complete downloading.

Moreover, an interface may be provided to transmit and receive data directly to and from external computers or the like.

In the present embodiment, preset song data are based on the SMF format. It is assumed that song data are input and output in the SMF format. However, the song data may be data of a unique format which enables to identify note data, which is composed of notes, timing data, and the like, and which is frequently used in sequencers or the like. Further, the song data may be of any format such as an "event+relative time" type in which the occurrence time of each performance event is expressed as time elapsed from the preceding event, an "event+absolute time" type in which the occurrence time of each performance event is expressed as an absolute time within a song or a bar, a "rest+note length " type in which performance data is expressed by pitches of notes and note lengths (or rests and rest lengths), or a "direct" type in which each performance event is stored in a memory region corresponding to the occurrence time of the performance event. Any of these formats enables automatic performance processing to be easily executed using a well-known technique.

FIGS. 2A to 2D are views showing the formats of data in various memories. FIGS. 2A, 2B, 2C, and 2D show the contents of data in the second ROM (preset memory), flash memory, RAM (work memory), and FD, respectively.

As shown in FIG. 2A, the second ROM 6B contains song entry data, style entry data, tone color entry data, setting entry data, other entry data, song data (demonstration songs), style data, tone color data, setting data (registration), and other data which are stored before the present apparatus is shipped.

As shown in FIG. 2B, the flash memory 21 contains data similar to the data stored in the second ROM 6B. However, nothing is stored in the flash memory 21 before the present apparatus is shipped. The flash memory 21 has song data stored therein by executing an external input process, shown in FIG. 10 and described later, to download the data via the communication network 101, load them from the external device 20, or load them from a "recording medium" such as an HD (hard disk; not shown) or the CD-ROM 12. The flash memory 21 also has song data stored therein when the data are read from the second ROM 6B into the RAM 7 for editing or other processing and are then resaved in the second ROM 6B.

As shown in FIG. 2C, the RAM 7 contains song names (file names), copyright data (predetermined right data), selected song data A, and other data. These data have been transferred to the RAM 7 by the second ROM 6B or flash memory for copying before execution of the external input process, shown in FIG. 10, or during an automatic performance process, shown in FIG. 11 and described later.

As shown in FIG. 2D, the FD 24 contains entry data, a plurality of song data A, B, and C, and other data. In the present embodiment, the FD 24 is illustrated as an external recording medium that provides song data. Song data from the FD 24 are stored in the flash memory 21. The recording medium providing song data is not limited to the FD 24 but may be, for example, an HD (hard disk) or the CD-ROM 12.

Figure 3:
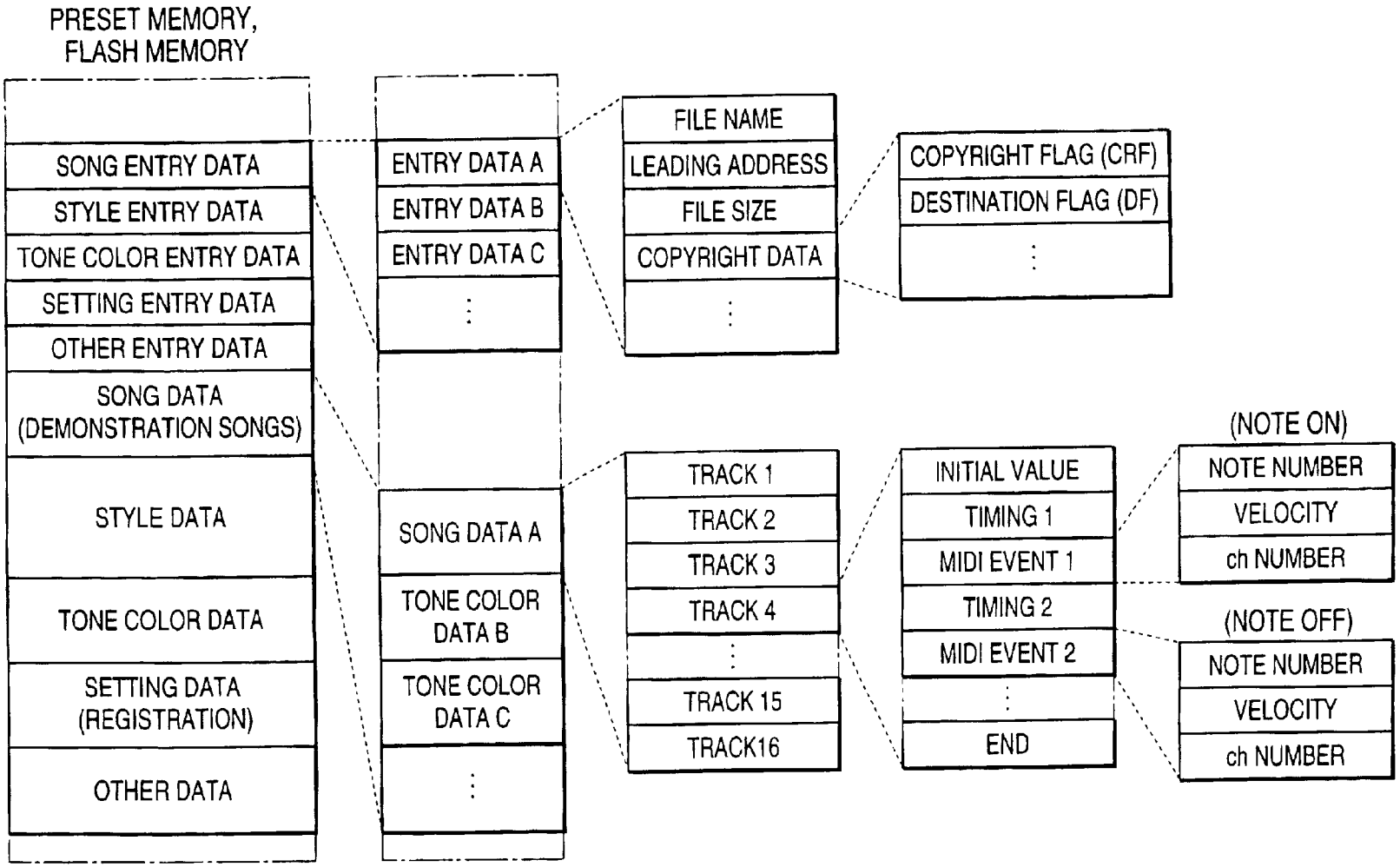
FIG. 3 is a view showing the details of the formats of data stored in the second ROM.

FIG. 3 is a view showing the details of the format of data stored in the second ROM 6B. The format of data stored in the flash memory 21 is similar to the format shown in FIG. 3.

The song data (demonstration songs) is always comprised of a plurality of song data such as song data A, B, and C. The song entry data is also comprised of a plurality of data such as song entry data A, B, and C corresponding to the song data A, B, and C, respectively. The other data are also provided for the respective song data. The entry data A, B, and C are each composed of 40 bytes for each song data file and each contain the name, leading address, and size of the corresponding song data file, copyright data, and other data. The copyright data contains a copyright flag CRF (0 or 1) and a destination flag DF (destination corresponding data) (0, 1, or 2).

The copyright flag CRF, when it is "0", indicates that the corresponding song data has no copyright to be protected, and when it is "1", indicates that the corresponding song data has a copyright. On the other hand, in the present embodiment, the destination flag D, when it is "0" or "1", indicates that the destination for the corresponding song data is Japan or foreign countries, and when it is "2", indicates that the destination for the corresponding song data is both Japan and foreign countries.

Moreover, the song data A, B, and C are each composed of track data (tracks 1 to 16), and each track data contains an initial value, timing data (timing 1, 2, and so forth), and MIDI data (MIDI events 1, 2, and so forth). The MIDI event data contains note numbers for note on and note off, velocity, channel numbers, and others.

Further, the style data indicates the style of automatic accompaniment such as 8 beats, 16 beats, rock, or jazz. The style data is used to give a performance by a user or automatic accompaniment according to chord progression. The tone color data is data of tone color parameters suitable for themes (the atmosphere of the tone color) and defines cutoff frequency values and various envelope values. The setting data (registration) defines settings as to tone color, volume, key transpose, tempo, effects, and others so as to match performance themes.

Figure 4:
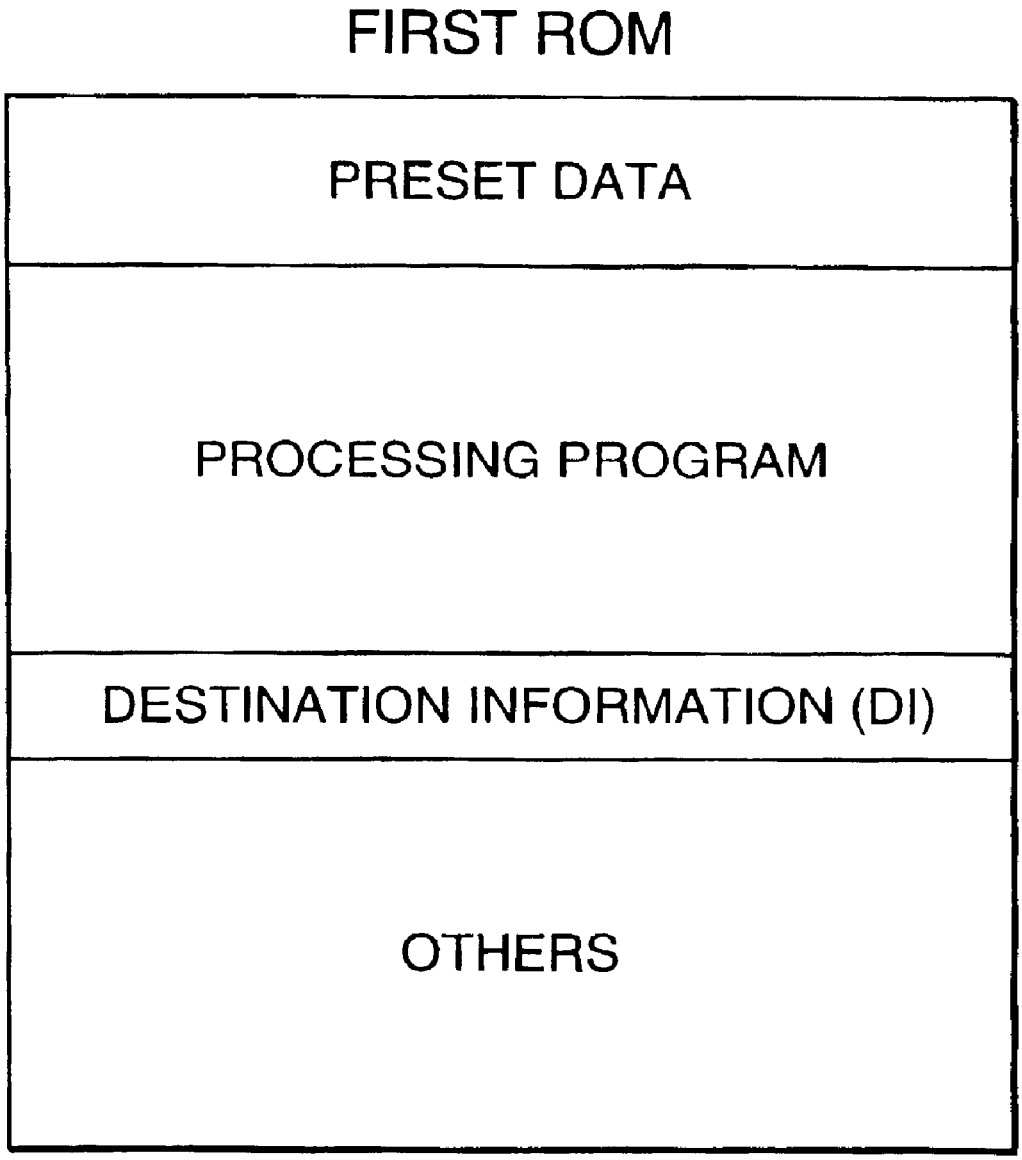
FIG. 4 is view showing the format of data in a first ROM.

FIG. 4 is a view showing the arrangement of data in the first ROM 6A.

The first ROM 6A contains preset data, processing programs, destination information (destination data) DI, and other data which are stored therein before shipment. The destination information DI is indicates a district or districts in which the present apparatus is sold, and is set to either "0" or "1". In the present embodiment, the destination information DI, when it is "0" or "1", indicates that the destination is Japan or foreign countries, respectively. For example, electronic music apparatuses destined for Japan have the destination information DI in the first ROM 6A set to "0".

Figure 5:
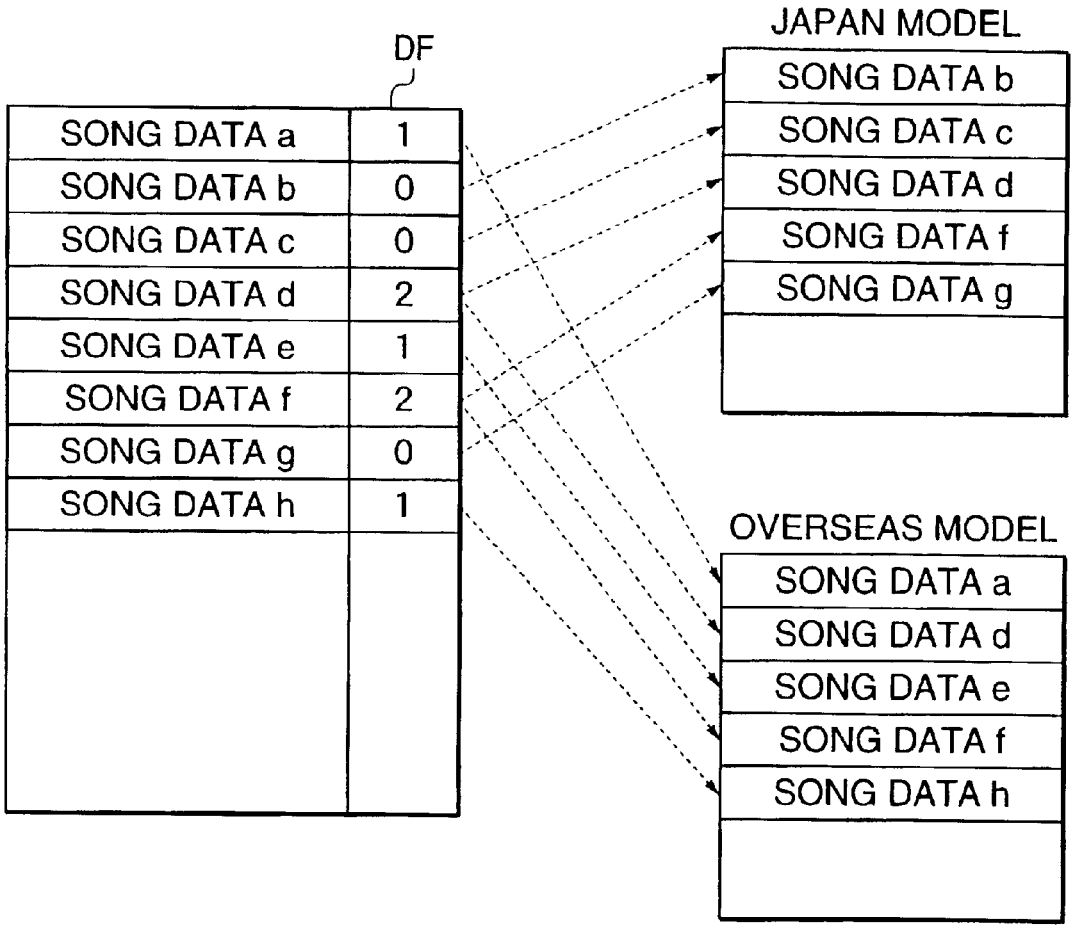
FIG. 5 is a view useful in explaining how access is made to song data according to destination information DI and a destination flag DF.

FIG. 5 is a view useful in explaining how access is made to song data based on the destination information DI and destination flag DF.

In a panel switch process, shown in FIGS. 7 and 8 and described later, when an instruction for listing song data is given, those song data of the group of song data in the second ROM 6B which have the destination flag DF set to "0" or "2" are extracted and actually listed if the destination information DI read out from the first ROM 6A is "0" (Japanese model). On the other hand, those song data which have the destination flag DF set to "1" or "2" are extracted and actually listed if the destination information DI read out from the first ROM 6A is "1" (overseas model). Song data that are not extracted cannot be accessed and are considered by the user to be absent from the apparatus.

Figure 6:
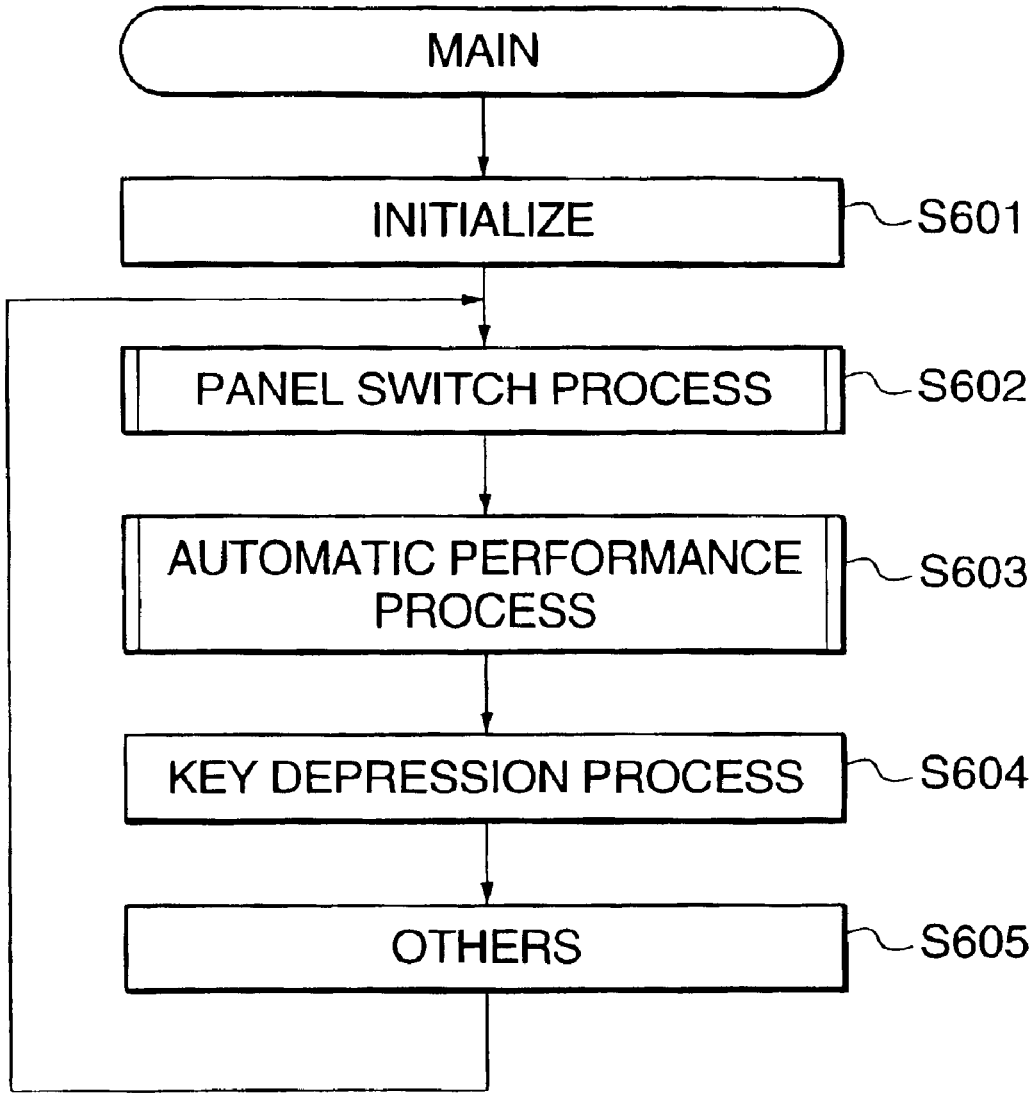
FIG. 6 is a flow chart of a main routine according to the present embodiment.

FIG. 6 is a flow chart of a main routine according to the present embodiment. This process is started when the power supply is turned on.

First, initializations are carried out, i.e. a predetermined program is executed to carry out clearing of various registers, flags, parameters, various interfaces, timers, and others and display of an initial screen, not shown, and other processing are carried out (step S601).

Then, the panel switch process, shown in FIGS. 7 and 8 and described later, is executed, i.e. operations of the panel switch 2 and the like are accepted to set volume, tempo, and the like, select a song, style, and others, start or stop automatic performance, set MIDI-OUT (real-time sequential outputting of song data through the MIDI I/F 13), and execute external inputting and outputting and other processes (step S602).

Then, the automatic performance process, shown in FIG. 11 and described later, is executed, i.e. reproduction of desired song data, a MIDI-OUT process, a key depression guiding process, and other processes are carried out (step S603). Then, a key depression process is executed, i.e. the user's key depressing operation is detected and converted into a MIDI event. The MIDI event is then transmitted to the tone generator circuit 15, which in turn generates sound. In this manner, performance processing or the like is executed in real time using the presently specified tone color (step S604). Then, other processes are executed (step S605) and the process returns to the step S602.

Figure 7:
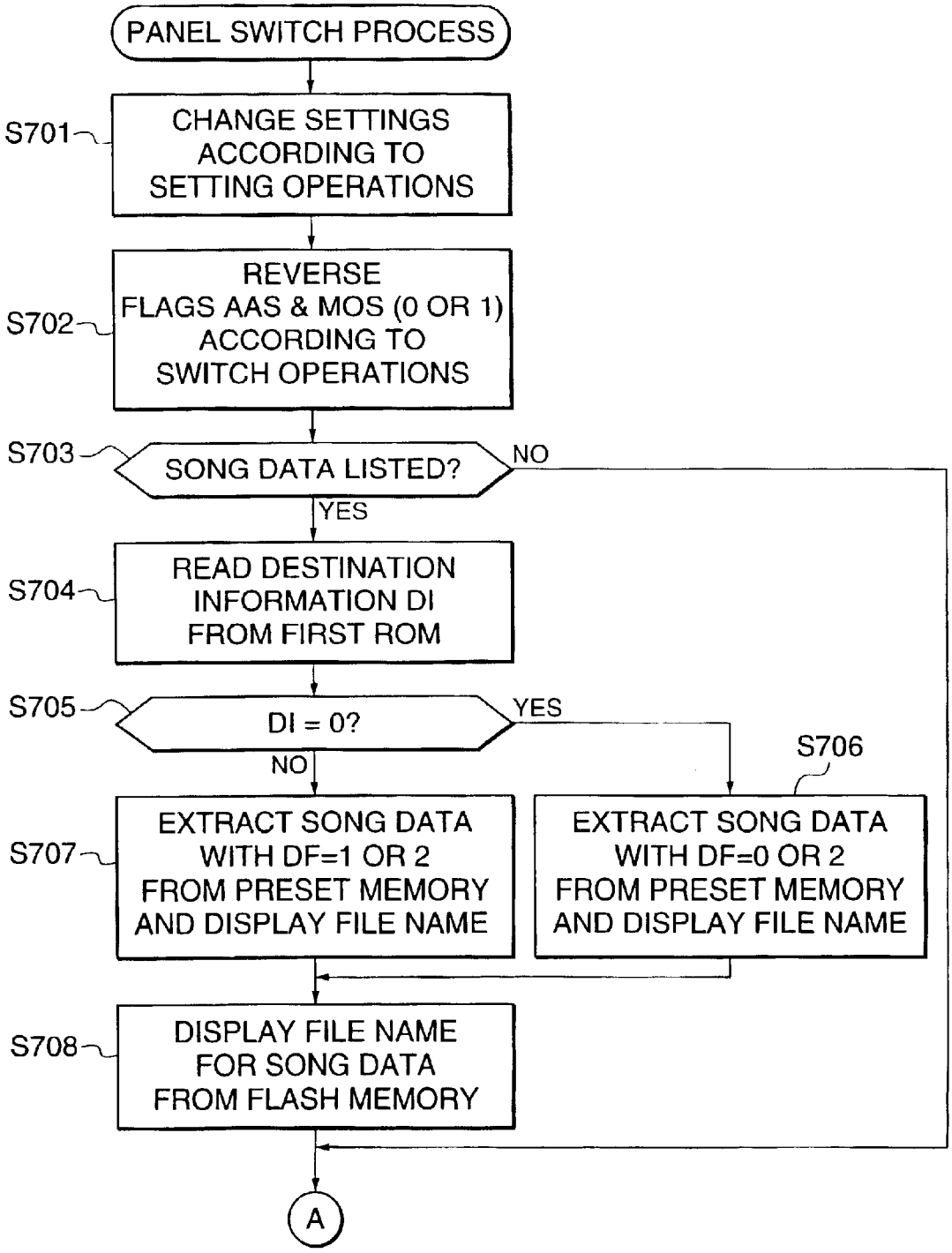
FIG. 7 is a flow chart of a panel switch process executed at a step S602 in FIG. 6.

FIG. 7 is a flow chart of the panel switch process executed in the step S602 in FIG. 6.

First, existing settings are changed according to setting operations (step S701). For example, if setting operations of the volume, tempo, key transpose, and others are carried out, the corresponding existing settings are changed according to the amounts of setting operations. Then, an automatic performance flag AAS and a MIDI-OUT flag MOS are reversed between "0" and "1" (step S702). That is, if an automatic performance start/stop switch, not shown, of the panel switch 2 is depressed, the automatic performance flag AAS is reversed. If a MIDI-OUT switch, not shown, is depressed, the MIDI-OUT flag MOS is reversed. Here, the automatic performance flag AAS and the MIDI-OUT flag MOS, when they are "1", indicate that an automatic performance is to be given and the MIDI-OUT process is to be executed, respectively.

Then, it is determined whether an instruction for listing song data has been given through operation of the panel switch 2 or the like (step S703). If it is determined no instruction for listing song data has been given, the process proceeds to a step S709. On the other hand, if it is determined that an instruction for listing song data has been given, the process proceeds to a step S704 to read the destination information DI from the first ROM 6A.

Then, it is determined whether or not the readout destination information DI is "0" (step S705). If it is determined that DI=0 holds, indicating that the present apparatus is destined for Japan, the process thus proceeds to a step S706. In this step, those of the song data in the second ROM 6B (preset memory) which have the destination flag set to "0" (destined for Japan) or "2" (destined for both Japan and foreign countries) are extracted and sequentially numbered. Then, the file name of each song data is displayed on the display device 19 together with the corresponding number (see the Japanese model shown in FIG. 5). Then, the process proceeds to a step S708.

On the other hand, if it is determined that the destination information DI is not 0 (DI=1), indicating that the present apparatus is destined for foreign countries, the process proceeds to a step S707. In this step, those of the song data in the second ROM 6B which have the destination flag set to "1" (destined for foreign countries) or "2" (destined for both Japan and foreign countries) are extracted and sequentially numbered. Then, the file name of each song data is displayed on the display device 19 together with the corresponding number (see the overseas model shown in FIG. 5). Then, the process proceeds to the step S708.

In the step S708, the song data stored in the flash memory 21 are similarly sequentially numbered, so that the file name of each song data is displayed on the display device 19 together with the corresponding number. In this case, the sequential number may be a number continuous from the number of each song data in the second ROM 6B or may start from 101.

Then, in the step S709, it is determined whether or not song data has been selected by the user. Here, if the display device 19 then display song data, the user can specify desired data out of the displayed data. However, the user can specify the desired song data by directly inputting the data without displaying the corresponding file name. If it is determined that no song data has been selected, the process proceeds to a step S713. On the other hand, if any song data has been selected, the process proceeds to a step S710 to read the selected song data from the second ROM 6B or flash memory 21 together with the corresponding file name and copyright data. These data are then written into the RAM 7 (work memory) in correspondence with each other (see FIG. 2C).

Then, it is determined whether or not an instruction for externally outputting the selected song data has been given by the user (step S711). If it is determined that an instruction for externally outputting the selected song has been given, an external output process, shown in FIG. 9 and described later, is executed (step S712), and the process proceeds to a step S713. On the other hand, if no instruction for externally outputting the selected song has been given, the process proceeds to the step S713.

In the step S713, it is determined whether or not an instruction for loading song data from an external source has been given by the user (for example, downloading via the communication network 101 or loading from a recording medium or the external device 20). If it is determined that an instruction for loading song data from an external source has been given, then an external output process, shown in FIG. 10 and described later, is executed (step S714), and the process proceeds to a step S715. On the other hand, if no instruction for loading song data from an external source has been given, then the process immediately proceeds to the step S715.

In the step S715, processes corresponding to other switch operations are executed, followed by the present process being terminated.

Figure 8:
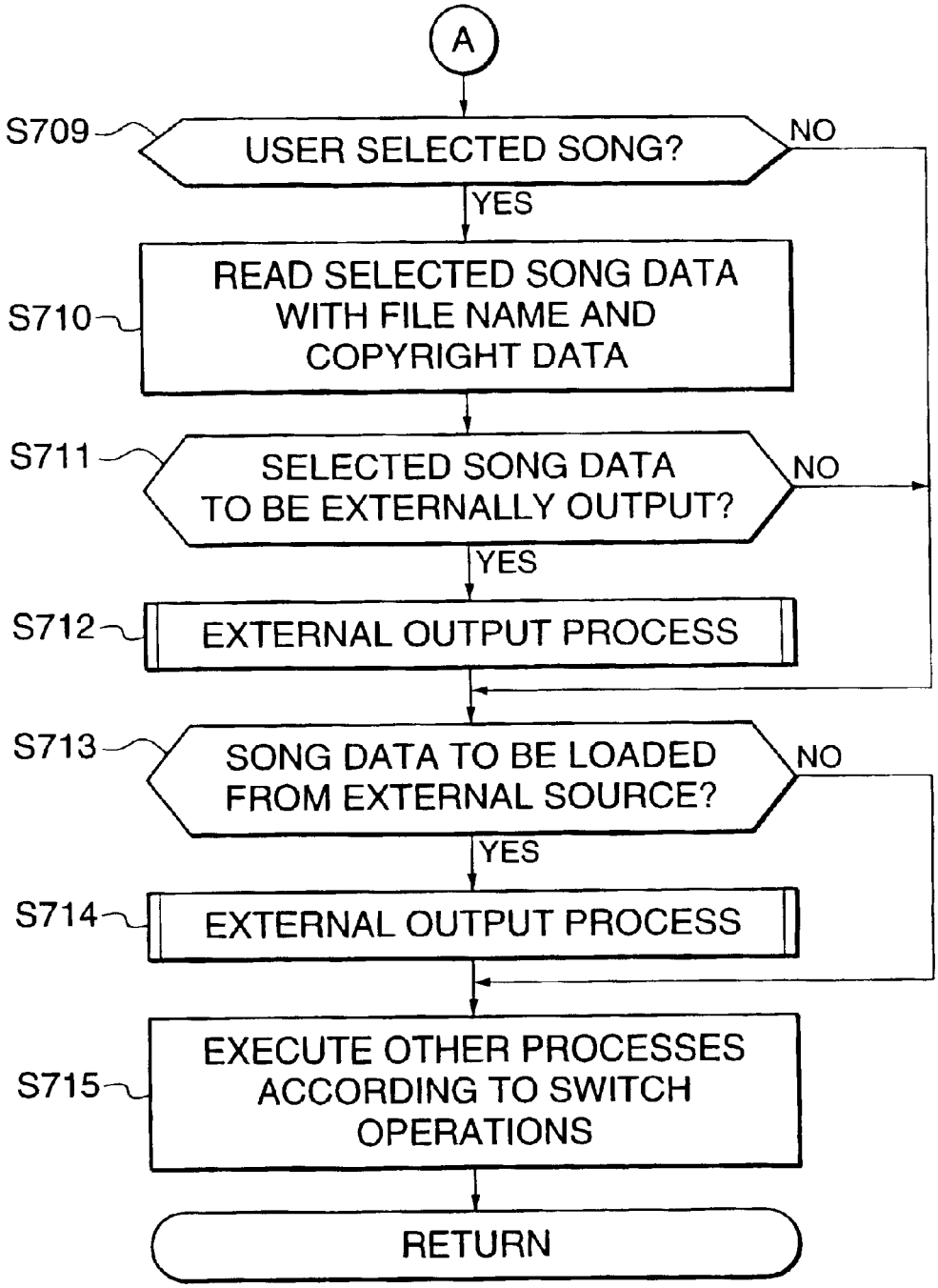
FIG. 8 is a continued part of the flow chart in FIG. 7.
Figure 9:
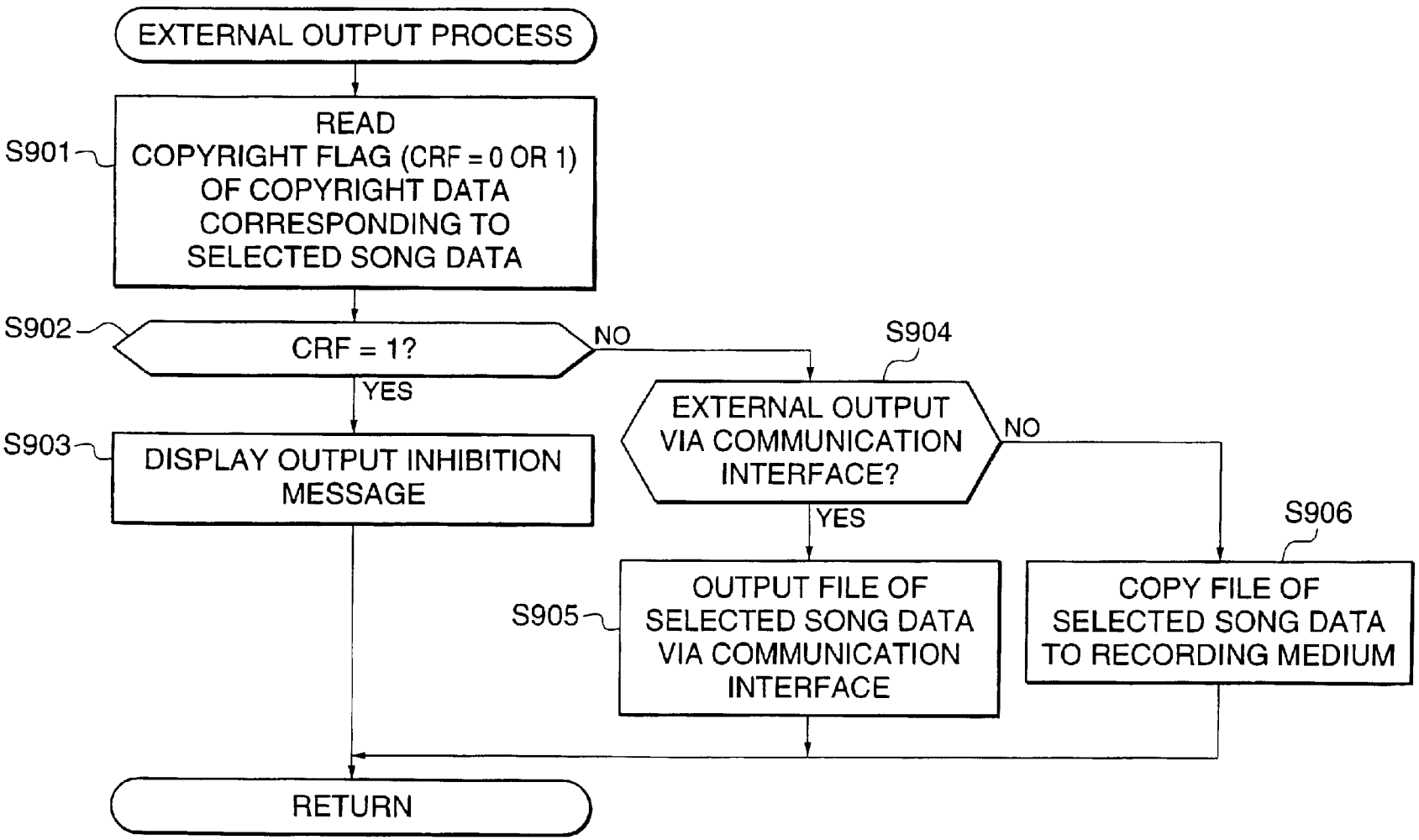
FIG. 9 is a flow chart showing an external output process executed at a step S712 in FIG. 8.

FIG. 9 is a flow chart showing the external output process executed in the step S712 in FIG. 8.

First, the copyright flag CRF in the copyright data corresponding to the selected song data is read out (step S901). It is then determined whether or not the copyright flag CRF is "1" (step S902).

In this case, the selected song data has already been written in the RAM 7 together with the copyright data in the step S710 in FIG. 7 8. Accordingly, in the step S901, the copyright flag CRF is read out from the RAM 7 so as to expedite the processing. Alternatively, the corresponding copyright flag CRF originally stored in the second ROM 6B or flash memory 21 may be read out for the determination.

If it is determined that CRF=1 holds, it is judged that the copyright must be protected, and then the process proceeds to a step S903 to display an output inhibition message on the display device 19, followed by the present process being terminated without providing any external outputting. In this case, the output inhibition message is, for example, "The selected song data is copyrighted and protected. External outputting and copying are inhibited."

On the other hand, if it is determined in the step S902 that the copyright flag is not "1" (CRF=0), it is judged that the copyright need not be protected, and then the process proceeds to a step S904 to determine whether or not the external output instruction is for outputting via the communication I/F 14. If it is determined that the external output instruction is for outputting via the communication I/F 14, the process proceeds to a step S905 to output the file of the selected song data via the communication I/F 14. For example, the file is uploaded into the external device 20 (for example, a personal computer or another electronic music apparatus) connected to the communication I/F 14 or the server computer 102. Subsequently, the present process is terminated.

It should be noted that if song data is output through the MIDI I/F 13, the song data can be transferred in the form of a file provided that a device that receives the song data has an environment in which predetermined software is available and the song data can be received as bulk data (MDR mode). Therefore, with such an environment, even if the external output instruction is for outputting through the MIDI I/F 13, it may be arranged such that the process proceeds from the step S904 to the step S905 to process this instruction as in the same manner as the case of outputting through the communication I/F 14.

On the other hand, it is determined in the step S904 that the external output instruction is not for outputting via the communication I/F 14, then the process proceeds to a step S906 to copy the selected song data onto a recording medium (the FD 42 or the like) according to the instruction, followed by the present process being terminated.

According to the present process, if the copyright flag CRF is "1", it is judged that the copyright must be protected for the selected song data. Thus, the song data is inhibited from being externally output through uploading, copying, or the like.

Figure 10:
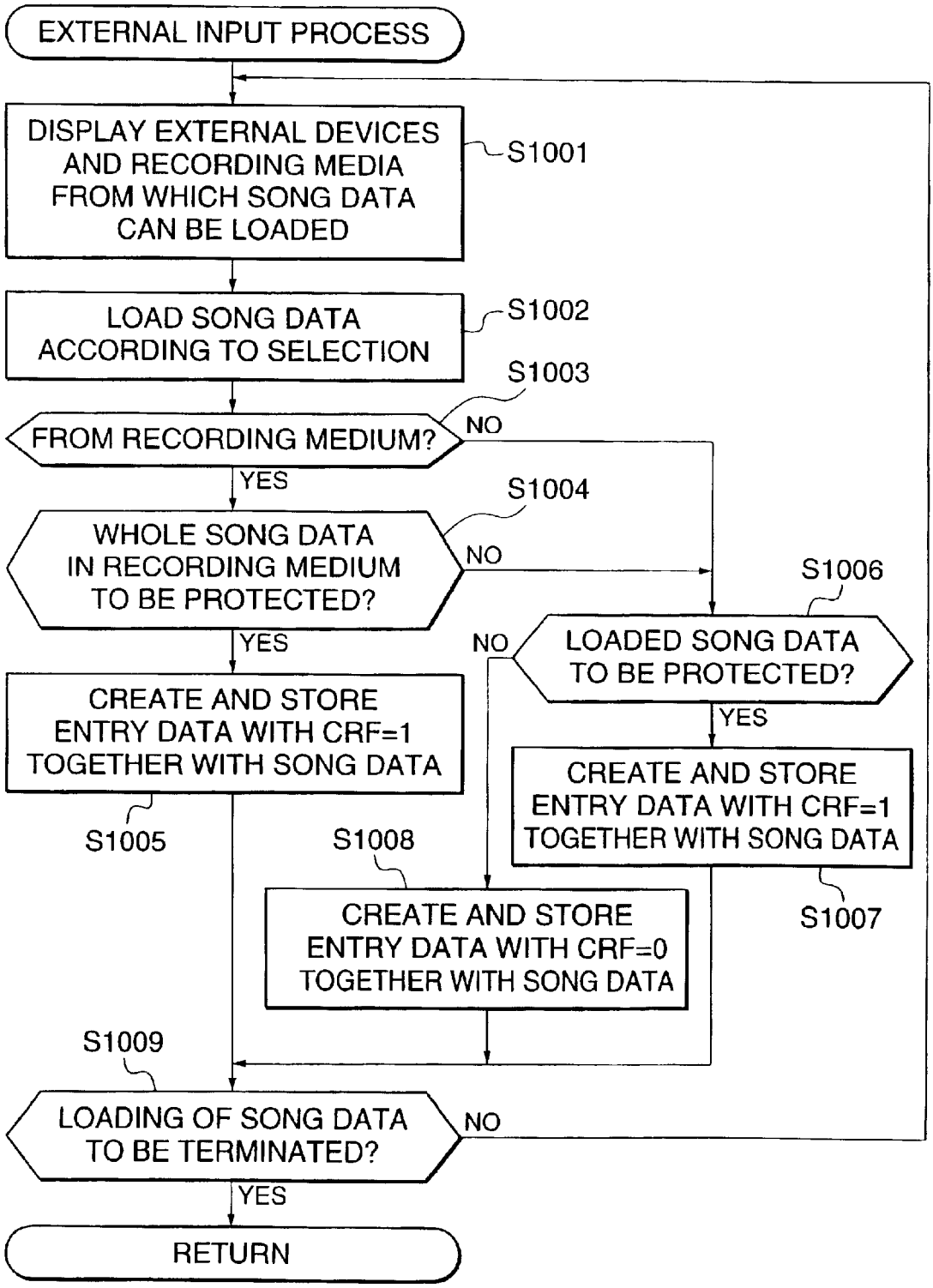
FIG. 10 is a flow chart of an external input process executed at a step S714 in FIG. 8.

FIG. 10 is a flow chart of the external input process executed in the step S714 in FIG. 8.

First, a list of external devices (the external device 20, server computer 102, and others) and recording media (the FD 24 and others) from which song data can be loaded through downloading or loading is displayed on the display device 19 (step S1001). Then, the user selects one of the displayed external devices and recording media as a loading source and also selects any of the song data in the loading source. Then, according to the selection, the song data is loaded from the source (step S1002).

In the present embodiment, in the step S1001, the second ROM 6B is also displayed as a candidate for the loading source. If the second ROM 6B is selected as the loading source, the song data is stored in the flash memory 21 through editing or another process. If there is any device that can transmit and receive song data as bulk data, these data may also be contained in the list.

Then, it is determined whether the loading source for the source data is a recording medium (step S1003). If it is determined that the loading source for the source data is a recording medium, it is determined whether or not all the song data in the recording medium are to be protected (step S1004). This determination is based on whether or not the recording medium contains a particular file indicative of copyright protection. It the recording medium contains the particular file, it is determined that all song data are to be protected. The particular file may be of any format insofar as it can be interpreted by the present apparatus. It suffices that certain suitable protection measures are only taken for each recording medium; For example, predetermined information may be attached to the root directory.

If it is determined that all the song data in the recording medium are to be protected, entry data is created and stored in the flash memory 21 together with the loaded song data (step S1005) (see FIG. 2B). The process then proceeds to a step S1009. In the created entry data, the copyright flag CRF in the copyright data is set to "1".

On the other hand, if it is determined in the step S1003 that the loading source for the song data is not a recording medium, the process proceeds to a step S1006. Further, if it is determined in the step S1004 that not "all the song data in the recording medium are to be protected", the process also proceeds to the step S1006.

In the step S1006, it is determined whether or not the song data loaded from the source is to be protected. This determination is made for each song data, and it is determined that the song data is to be protected if the song data contains data used to display the copyright, is subjected to predetermined scrambling, or contains predetermined watermark information. Other information may be used insofar as it indicates that each song data is to be protected and it can be interpreted by the present apparatus and insofar as certain suitable protection measures are taken for each song data.

If it is determined that the song data loaded from the source is to be protected, then as in the case of the step S1005, entry data is created with the copyright flag set to "1" and is then stored in the flash memory 21 together with the selected song data (step S1007). The process then proceeds to the step S1009. The steps S1005 and S1007 enable even copyrighted song data loaded from the recording medium to be protected using unified information (i.e. of a predetermined format) based on the copyright flag CRF according to the present invention.

On the other hand, it is determined in the step S1006 that the song data loaded from the source need not be protected, then the process proceeds to a step S1008 to create entry data and store it in the flash memory 21 together with the loaded song data. In this case, since the loaded song data has no copyright to be protected, the copyright flag CRF in the copyright data of the created entry data is set to "0".

Then, in the step S1009, it is determined whether or not loading of the song data is to be terminated. If it is determined that loading of the song data is not to be terminated, the process returns to the step S1001. On the other had, if loading of the song data is to be terminated, the present process is terminated.

According to the present process, song data are loaded from the recording medium or external device. At this time, if the copyright is protected, the song data are stored in the flash memory 21 together with entry data with the copyright flag CRF set to "1".

Figure 11:
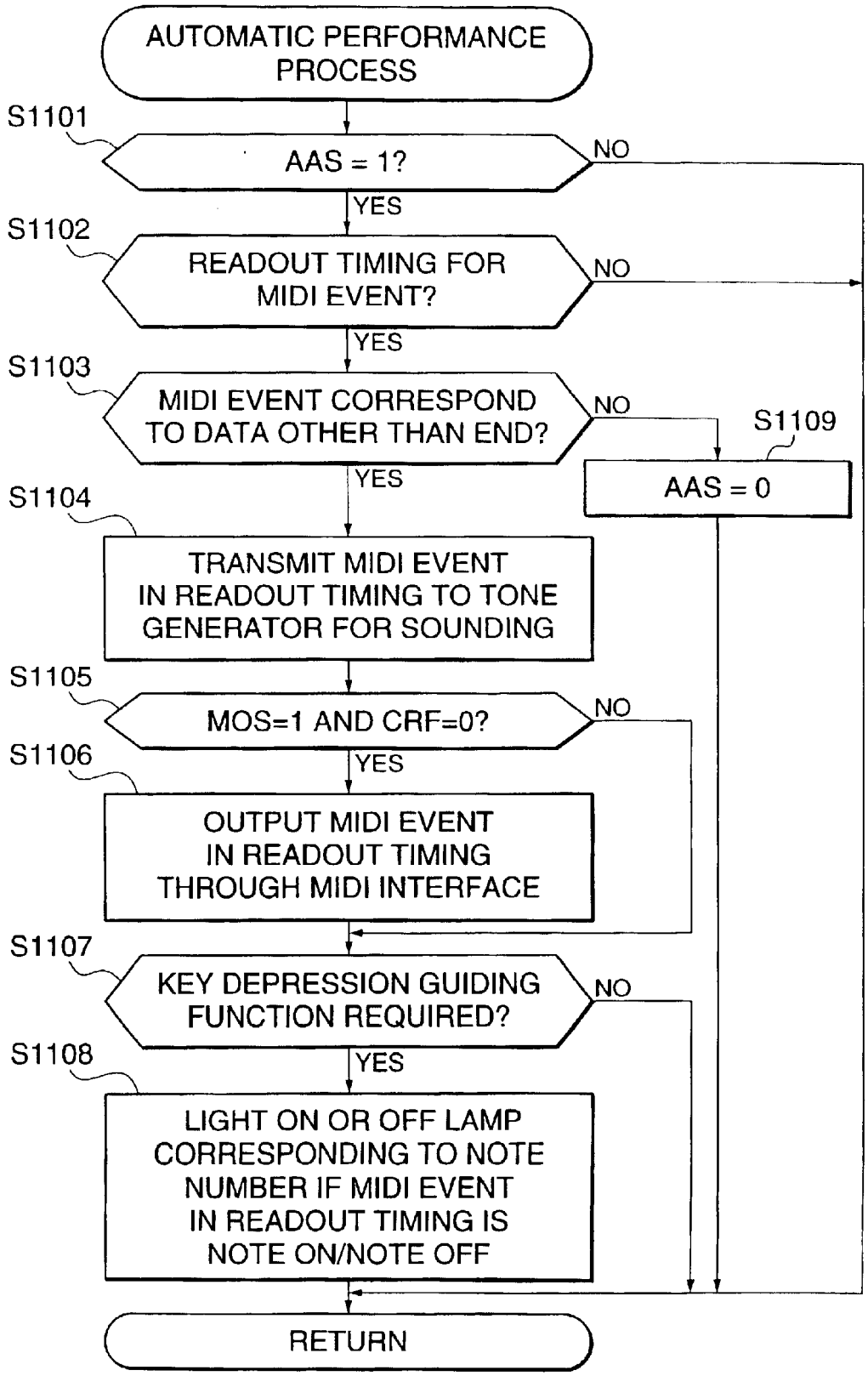
FIG. 11 is a flow chart of an automatic performance process executed at a step S603 in FIG. 6.

FIG. 11 is a flow chart of the automatic performance process executed in the step S603 in FIG. 6.

First, it is determined whether or not the automatic performance flag AAS is set to "1" (step S1101). If it is determined that the automatic performance flag AAS is not set to 1, the present process is immediately terminated. On the other hand, if it is determined that AAS=1 holds, indicting that an automatic performance is to be given, and then the process proceeds to a step S1102 to determine whether or not for the song data in the RAM 7 (work memory), timing for reading a MIDI event has been reached (step S1102). If it is determined that timing for reading a MIDI event has not been reached, the present process is terminated. On the other hand, if it is determined that timing for reading a MIDI event has been reached, the process proceeds to a step S1103 to determine whether or not the present MIDI event is data other than "END".

If it is determined that the present timing is data other than "END", the MIDI event in the readout timing is transmitted to the tone generator circuit 15, which in turn generates sound (step S1104). The process then proceeds to a step S1105. On the other hand, if the present MIDI event is not data other than "END" (it is END data), the automatic performance flag AAS is set to "0" (step S1109), followed by the present process being terminated.

In the step S1105, it is determined whether or not the MIDI-OUT flag MOS is set to "1" and the copyright flag CRF is set to "0". In this case, as in the case of the step S901 in FIG. 9, the copyright flag CRF that has been written in the RAM 7 is read out to expedite the processing.

If it is determined that MOS=1 and CRF=0 hold, indicating that the MIDI-OUT has been set and the MIDI-OUT process can be executed on the song data under no regulations due to copyright protection. Thus, the process proceeds to a step S1106 to output the MIDI event in the readout timing via the MIDI I/F 13, i.e. sequentially output the song data in real time. The process then proceeds to a step S1107. On the other hand, if it is determined that at least either of MOS=0 or CRF=1 holds, then MIDI-OUT has not been set or the data is to be regulated due to copyright protection even if the MIDI-OUT has been set. Accordingly, the process proceeds to the step S1107 without executing the MITI-OUT process. As a result, even if MIDI-OUT has been set, the MIDI-OUT process is inhibited from being executed on song data with the copyright flag CRF set to "1".

In the step S1107, it is determined whether or not a key depression guiding function has been set. If it is determined that the key depression guiding function has not been set, the present process is terminated. On the other hand, if the key depression guiding function has been set, a key depression lamp, not shown, is controlled to be lighted on or off according to the MIDI event in the readout timing (step S1108). Then, the present process is terminated. For example, if the MIDI event is a note on/note off, the corresponding lamp is lighted on or off.

According to the present process, when an automatic performance is to be given, song data with the copyright flag CRF set to "1" are determined to have a copyright to be protected. Thus, these data are inhibited from being output through the MIDI I/F.

According to the present embodiment, copyright data are stored in the second ROM 6B, in which song data are preset, in correspondence with the latter. Then, if the song data are to be externally output through uploading, copying, or the like, the outputting is controlled according to the copyright flag CRF in the copyright data. For example, song data with CRF=1 are uniformly inhibited from being externally output to protect copyrights thereof. On the other hand, song data such as PD songs for which copyright protection is not needed are allowed to be externally output and thus freely used, thereby meeting the convenience of the user. Therefore, external outputting of song data with copyrights can be individually limited for each song to protect the copyrights, whereas song data without any copyrights can be effectively used. Further, if song data are externally output or are output through MIDI-OUT for automatic performance, the song data are temporarily written into the RAM 7. Also in this case, checks are carried out using the copyright flag CRF. Therefore, even if song data are externally output or output through MIDI-OUT, the copyrights can be sufficiently and reliably protected.

Furthermore, when song data are externally output, the song data are written into the RAM 7 together with corresponding copyright data, and the copyright flag CRF is used to refer to the contents in the RAM 7. This expedites the process of determining whether or not the song data can be output.

Furthermore, if song data with a copyright to be protected is loaded from an external source, entry data with the copyright flag set to "1" is created and stored in the flash memory 21 together with the song data. It is then determined whether or not the song data stored in the flash memory 21 can be output, based on the copyright flag CRF. Thus, not only songs preset in the second ROM 6B but also song data obtained after shipment can have copyrights thereof protected or can be effectively used. Furthermore, the song data in the second ROM 6B can be restored in the flash memory 21 after being subjected to editing or another process. In this case, the copyright flag CRF is attached to the song data without being changed. Therefore, even if a preset song is restored after having its file name changed, being edited, or being subjected to another process, its copyright can be consistently protected.

Furthermore, when song data are loaded from an external source, if certain copyright protection measures have been taken for the song data, when stored in the flash memory 21, the song data are converted into a format (copyright flag CRF) defined by the present apparatus to enable execution of a determination as to whether or not copyrights thereof must be protected. Thus, even if the copyright data of the externally loaded song data have different formats, the copyrights can be more reliably protected by using the unified copyright data format inside the apparatus to enable the copyright data to be easily managed.

Further, according to the present embodiment, all song data are stored in the second ROM 6B irrespective of whether the data are for Japan or for foreign countries. Furthermore, the destination flag DF is set to a value corresponding to each of the song data, and in the first ROM 6A of the present apparatus, the destination information DI set to "0" is stored for apparatuses destined for Japan, while the destination information DI set to "1" is stored for apparatuses destined for foreign countries. Thus, when song data are listed on the display device, then depending on whether the destination information DI read from the first ROM 6A is "0" or "1", only the corresponding song data are displayed, whereby only appropriate song data are available. This eliminates the need to create and manage different first ROMs 6A for Japan and for foreign countries, thus simplifying creation and management of the first ROM 6A. Thus, the first ROM 6A can be shared to simplify the construction of the apparatus and reduce costs.

In the present embodiment, different processing programs executed by the present apparatus are stored for different destinations. However, as with song data, both a processing program for Japan and one for foreign countries may be stored in the first ROM 6A so that processing programs to be actually executed can be selected according to the destination data DI. In this case, for example, instead of storing the destination information DI, shown in FIG. 4, in the first ROM 6A, 1 bit of an I/O port, not shown, connected to the CPU 5 may be used to set "0" for Japan and "1" for foreign countries.

In the present embodiment, two destinations are illustrated. However, the present invention is also applicable to three or more destinations. The numbers of pieces of destination information DI and of destination flags DF may be increased depending on the number of destinations.

In the present embodiment, according to the illustrated manner of controlling external outputting of song data, the song data are uniformly or unlimitedly permitted to be output or inhibited from being output. However, the present invention is not limited to this, but the outputting of the song data may be permitted or inhibited under certain conditions. For example, song data may be permitted to be output to a particular destination or particular destinations, or may be permitted to be output together with information that permits the data to be copied as a file only for one generation according to the contents of the related consent to the use of the copyright.

In the present embodiment, the recording medium in which song data are stored before shipment and the recording medium that stores song data transferred by the present apparatus are not limited to the FD 24 given above for example or the like, These recording media may be selected from various media such as a magnet optical disk, CD-R/RW, magnetic tape, PD (Phase change Disk), DVD-RAM, and DVD-R/RW.

In the present embodiment, when song data are output from the second ROM 6B or the flash memory 21, they are written in the RAM 7, from which they are then output. However, the output regulation of song data based on the copyright flag CRF is not limited to the outputting via the RAM 7, but is also applicable to a case in which the data are output directly from the second ROM 6B or the flash memory 21.

In the present embodiment, if style data, tone color data, setting data, and other data have copyrights, these data may be controlled by, for example, regulating their outputting based on copyright data as in the case of song data.

Although the above described embodiment is directed to song data having copyrights to be protected, the present invention is not limited to this, but the output regulation may be also performed on data having other kinds of right than the copyright using data similar to the copyright data.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of the embodiment described above, and hence the storage medium on which the program code is stored constitutes the present invention. Further, also in the case where the program code is supplied via an electrographic medium, the program code itself constitutes the present invention. Examples of the storage media for supplying the program code include not only the ROM but also a floppy (registered trademark) disk, a hard disk, an optical disk, a magnetic-optical disk, a CD-ROM, a CD-R, a CD-RW, DVD-ROM, a DVD-RAM, a DVD-RW, a DVD+RW, a magnetic tape, and a nonvolatile memory card.

It also goes without saying that the functions of the above described embodiment may be accomplished not only by executing a program code read out by a computer, but also by causing an OS or the like that operates on the computer to perform a part or the whole of the actual operations according to instructions of the program code. Furthermore, it is to be understood that the functions of the above described embodiment may be accomplished by writing the program code read out from the storage medium into a memory provided in an expanded board inserted in the computer, or an expanded unit connected to the computer, and causing a CPU or the like provided in the expanded board or expanded unit to actually perform a part or all of the operations according to the instructions of the program code.

What is claimed is:

1. An electronic music apparatus comprising:

a first storage device that stores a plurality of song data and predetermined right data corresponding to each of the plurality of song data in correspondence with each other;

a musical tone signal generating device that externally generates musical tone signals based on the song data stored in said first storage device;

a switch for instructing real-time outputting of the song data;

an external output device capable of externally outputting in real-time the song data stored in said first storage device in a form of MIDI data, in response to operation of said switch;

an output accepting device that accepts an output instruction for selectively outputting the song data stored in said first storage device; and an output control device responsive to acceptance of the output instruction by said output accepting device, for controlling external outputting of the song data by said external output device based an the predetermined right data corresponding to the song data selected according to the accepted output instruction;

wherein said output control device provides control such that if the predetermined right data corresponding to the selected song data indicates that right protection is required, the selected song data is inhibited from being externally output irrespective of whether said switch is operated to instruct real-time outputting of the selected song data.

2. An electronic music apparatus according to claim 1, further comprising a second storage device, and wherein when the song data stored in the first storage device are externally output, the output song data are transferred together with the predetermined right data corresponding thereto to said second storage device, wherefrom the transferred song data are externally output, and wherein said output control device reads the predetermined right data corresponding to the selected song data out from said second storage device, and controls external outputting of the song data by said external output device based on the read predetermined right data.

3. An electronic music apparatus according to claim 1, wherein said output control device provides such control that if the predetermined right data corresponding to the selected song data indicates that no right protection is required, the selected song data is permitted to be externally output, and if the predetermined right data corresponding to the selected song data indicates that right protection is required, the selected song data is inhibited from being externally output.

4. An electronic music apparatus according to claim 1, wherein said first storage device comprises a first built-in memory that stores the plurality of song data and the corresponding predetermined right data.

5. An electronic music apparatus according to claim 1, wherein said first storage device comprises a first built-in memory in which are stored in advance the plurality of song data and the corresponding predetermined right data, and a second built-in memory capable of loading and storing the song data and the predetermined right data from at least one of an external data providing device in which are stored in advance the plurality of song data and the corresponding predetermined right data and said first built-in memory.

6. An electronic music apparatus according to claim 5, comprising a conversion and loading device operable when the song data and the predetermined right data are loaded from the external data providing device into said second built-in memory, to convert the predetermined right data into a predetermined format before being stored in said second built-in memory irrespective of a format in which the predetermined right data are stored in said external data providing device.

7. An electronic music apparatus according to claim 5, wherein when the song data and the predetermined right data are loaded from said first built-in memory into said second built-in memory, the predetermined right data are directly stored without being changed in said second built-in memory together with the corresponding song data.

8. An electronic music apparatus according to claim 1, wherein said external output device has at least one of a function of outputting the song data in a form of a file and a function of outputting in real time the song data in a form of MIDI data.

9. An electronic music apparatus that provides different songs contained therein for different destinations, comprising:

a song data storage device that stores a plurality of song data and destination corresponding data indicative of destinations for respective ones of the plurality of song data in correspondence with each other;

a destination data storage device that stores destination data indicative of a destination set for the electronic music apparatus;

an access device that makes access to the song data stored in said song data storage device to use the song data; and an access control device that provides such control that said access device is permitted to make access to only song data, out of the song data stored in said song data storage device, corresponding to destination corresponding data matching the destination data stored in said destination data storage device, and is inhibited from accessing other song data.

10. An electronic music apparatus according to claim 9, wherein said song data storage device stores song data for a plurality of destinations and destination corresponding data corresponding to respective ones of the song data for the plurality of destinations, whereby said song data storage device can be shared by electronic music apparatuses for the plurality of destinations.

11. A program for causing a computer to execute a method of controlling an electronic music apparatus having a storage device that stores a plurality of song data and predetermined right data corresponding to each of the plurality of song data in correspondence with each other, the program comprising:

a musical tone generating module for generating musical tone signals based on the song data stored in said storage device;

an external output module capable of externally outputting in real time the song data stored in said storage device in a form of MIDI data, in response to operation of a switch for instructing real-time outputting of the song data;

an output accepting module for accepting an output instruction for selectively outputting the song data stored in said storage device; and an output control module responsive to acceptance of the output instruction by said output accepting module, for controlling external outputting of the song data by said external output module based on the predetermined right data corresponding to the song data selected according to the accepted output instruction;

wherein said output control module for providing control such that if the predetermined right data corresponding to the selected song data indicates that right protection is required, the selected song data is inhibited from being externally output irrespective of whether the switch is operated to instruct real-time outputting of the selected song data.

12. A program for causing a computer to execute a method of controlling an electronic music apparatus that provides different songs contained therein for different destinations, the electronic music apparatus having a song data storage device that stores a plurality of song data and destination corresponding data indicative of destinations for respective ones of the plurality of song data in correspondence with each other, and a destination data storage device that stores destination data indicative of a destination set for the electronic music apparatus, the program comprising:

an access module for making access to the song data stored in said song data storage device to use the song data; and access control module for providing such control that said access module is permitted to make access to only song data, out of the song data stored in said song data storage device, corresponding to destination corresponding data matching the destination data stored in said destination data storage device, and is inhibited from accessing other song data.

* * * * *